US006458191B1

(12) United States Patent
Lingelem et al.

(10) Patent No.: US 6,458,191 B1
(45) Date of Patent: Oct. 1, 2002

(54) SEPARATOR INLET

(75) Inventors: Morten Lingelem, Sandefjord (NO); Bård Strand, Oslo (NO); Pål Jahre Nilsen, Bødalen (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 09/623,628

(22) PCT Filed: Mar. 3, 1999

(86) PCT No.: PCT/NO99/00073

§ 371 (c)(1),
(2), (4) Date: Dec. 29, 2000

(87) PCT Pub. No.: WO99/44747

PCT Pub. Date: Sep. 10, 1999

(30) Foreign Application Priority Data

Mar. 6, 1998 (NO) ..... 19980971

(51) Int. Cl.[7] ..... B01D 19/00
(52) U.S. Cl. ..... 96/209; 96/216

(58) Field of Search ..... 96/206, 208, 209, 96/216; 55/459.1, 459.3; 95/260, 261

(56) References Cited

U.S. PATENT DOCUMENTS

| | | | | |
|---|---|---|---|---|
| 1,045,532 A | * | 11/1912 | Dyblie | 209/722 |
| 4,070,168 A | | 1/1978 | Beattie | |
| 5,256,171 A | | 10/1993 | Payne | |
| 5,535,595 A | * | 7/1996 | Manz | 62/475 |

FOREIGN PATENT DOCUMENTS

| | | |
|---|---|---|
| DE | 3529760 | 2/1987 |

* cited by examiner

*Primary Examiner*—Robert A. Hopkins
(74) *Attorney, Agent, or Firm*—Wenderoth, Lind & Ponack, L.L.P.

(57) ABSTRACT

A separator inlet includes a spiral channel in a channel housing and having an open top. Fluid flows in tangentially and out of a central outlet of the channel housing, or in a reverse direction.

10 Claims, 2 Drawing Sheets

SEPARATOR INLET

BACKGROUND OF THE INVENTION

The invention concerns an inlet for a separator (separator tank) in a process plant, for example a plant for processing a fluid consisting of oil, water and/or gas.

The inlet arrangement in a separator in a process plant usually has several purposes. First, the inlet reduces the impulse to incoming fluid to prevent the inlet flow from disturbing the steady flow conditions required in the separator. Second, the inlet prevents sand or similar material in the process flow from being deposited in places where this is undesirable. Thirdly, the inlet prepares the process flow so that the conditions for good separation are optimal.

In practice, impulse reduction is usually the guiding factor for the design of an inlet in a separator. A widely known impulse reduction solution is based on the use of a flow interruption plate arranged just outside the separator inlet. The fluid flow meets the plate and is spread outwards and possibly backwards if the plate is curved. Another impulse reduction solution is based on the use of a U-shaped pipe in connection with the inlet to "return" the flow towards the separator wall. A third solution is based on the use of a T-pipe section in connection with the inlet to interrupt the fluid flow and steer it sideways.

However, all of these solutions create a greater or lesser degree of spray, agitation and disturbance to the surface of the fluid, which means that the conditions for good separation are not achieved or are poor. If the fluid supply flow consists of oil and water, large shear stresses, for example as a result of pressure loss across a valve or sudden changes of speed, can lead to the oil and/or water being turned into small drops and a so-called emulsion being formed. In its simplest form, the emulsion is either oil-in-water (oil drops in water) or water-in-oil (water drops in oil). Surfactants in the oil can stabilize the emulsion and make it difficult to separate the oil and water. Water-in-oil emulsions are considered to be more difficult to break down than oil-in-water emulsions.

If the fluid supply flow contains free gas in addition to oil and water, shear stresses to which the fluid supply flow is exposed can lead to the formation of small gas bubbles which are mixed with the fluid phases. These gas bubbles can have an emulsion-stabilizing effect like the surfactants in oil.

SUMMARY OF THE INVENTION

The present invention represents an inlet to a separator in which the fluid inlet flow is not exposed to unnecessarily large shear stresses (plunging, sudden changes of speed), and in which free gas which may be present in the fluid supply flow is released before the fluid flow is exposed to shear stresses. Moreover, the present invention represents an inlet which produces steady flow conditions in the separator and prevents any sand or other particulate contaminants from being deposited in places where this is undesirable.

The present invention is characterized in that the separator inlet is designed as a spiral channel open at the top in a channel housing. The fluid flows in tangentially and flows out through a central outlet in the housing downwards.

BRIEF DESCRIPTION OF THE DRAWINGS

The present invention will be described in the following in further detail with reference to the attached drawings, in which.

DETAILED DESCRIPTION OF THE INVENTION

Figure 1:
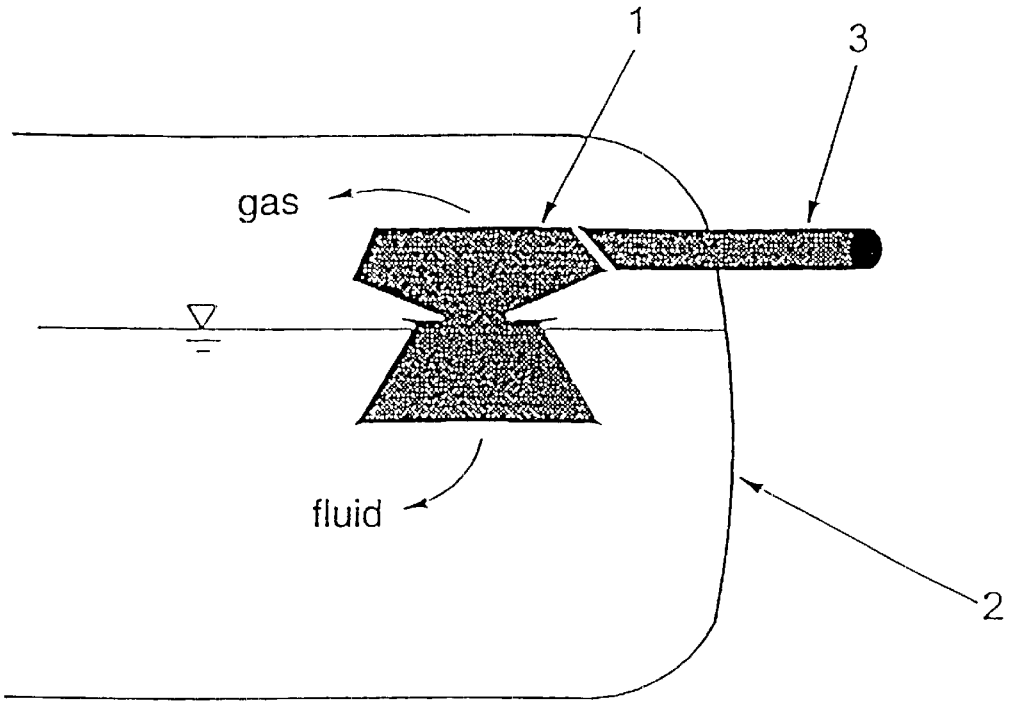
FIG. 1 shows a separator inlet in accordance with the present invention arranged in a separator tank.

FIG. 1 shows, as stated, a separator inlet 1 in accordance with the present invention arranged in a separator tank 2. The separator inlet is placed in connection with the surface of the fluid, and the fluid is supplied to the separator inlet from outside via a supply line 3.

Figure 2:
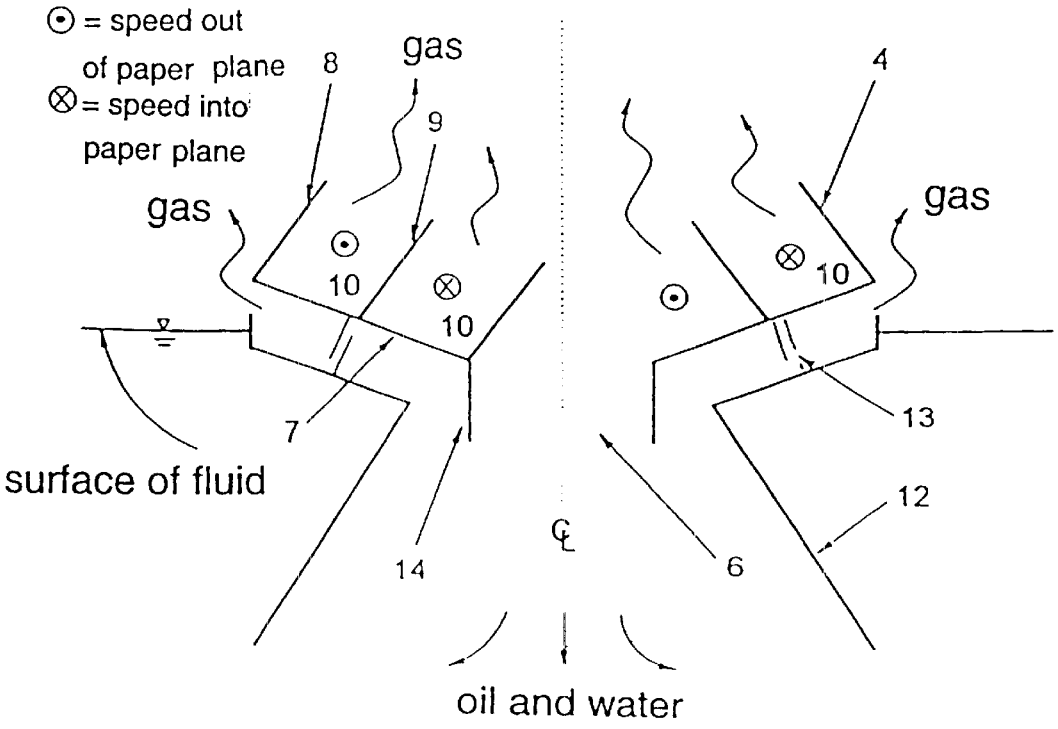
FIG. 2 shows, in the form of a schematic diagram, an outline of the separator inlet.
Figure 3:
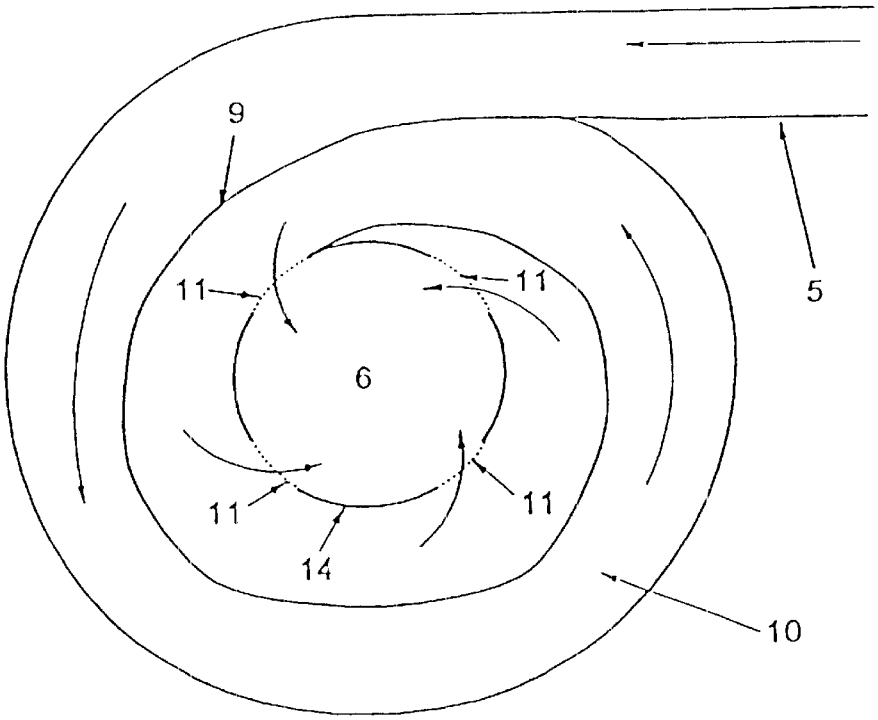
FIG. 3 is a schematic diagram of the same inlet seen from above.
Figure 4:
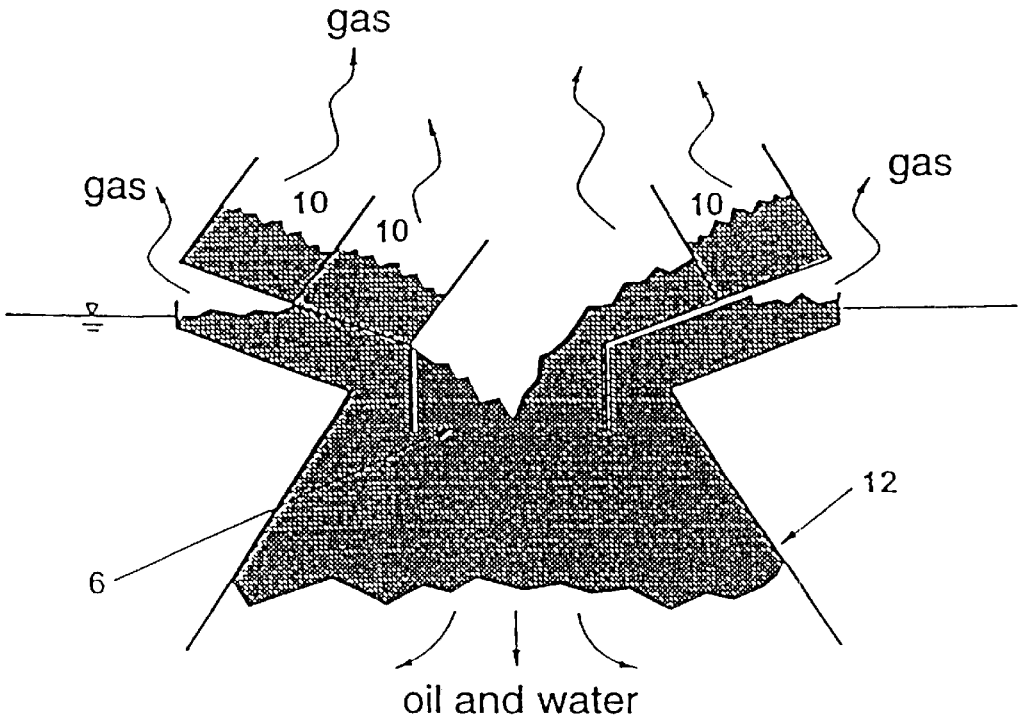
FIG. 4 is a schematic diagram of the inlet shown in FIG. 2 during operation, i.e. filled with a fluid, for example oil/water containing gas.

The separator inlet 1 comprises, as shown in FIG. 2 and FIG. 3, a channel housing 4 with channels 10 open at the top which run from a tangentially-located connection line (first line) 5 for the supply line 3 in a spiral path to an outlet line (second line) 6 which is arranged centrally in the housing 4.

The housing 4 may expediently be made of a disc-shaped plate 7 and inward-sloping plates 8, 9 arranged on this disc-shaped plate 7 which run in a spiral path and form walls in a channel 10. A circular, pipe-shaped part with openings 11 to the channel 10 may also expediently form the outlet 6 in the housing. The housing 4 may be equipped with a lid over the channel, but any lid must be provided with openings for the evacuation of gas.

In order to trap any gas bubbles which are released at the outlet line (second line) 6 in the housing 4, it is preferable to arrange a funnel-shaped gas trap 12 which is connected to the housing via mounting pieces 13. The gas trap 12 is designed to extend slightly below the second line 6 to just above the surface of the fluid outside the housing 4.

The separator inlet works in the following way. The fluid is introduced into the channel 10 in the housing 4 from the pipe 5 and flows in spiral path through the channel 10 in the housing to the outlet 6 while releasing any gas. The fluid then flows downwards through the outlet 6, and any remaining gas will be trapped by the funnel-shaped trap 12 and conveyed to the surface. Alternatively, the flow can be in the opposite direction (i.e., the inflow can be via the centrally-located second line 6 from above, and the outflow can be tangential via the first line 5, which will be immersed in the fluid in the separator).

The housing may expediently be made by casting or of welded plates of a corrosion-resistant material, for example stainless steel.

EXAMPLE

Comparative tests were performed in a Plexiglas model of a separator in the scale 1:4.5. Water, Exxol D80® and air were used for the three phases in the fluid, which was supplied to a separator inlet in accordance with the present invention and to a well known separator inlet of the impulse type with two sets of plate packs in the water phase. The tests for the two separator types were performed under the following conditions.

| | |
|---|---|
| Water cut (percentage content of water) | 60% |
| Gas/fluid ratio (volume) | 1.2 |
| Mixing speed (inflow speed of fluid) | 6 mls |

Oil in water was measured with a Horiba® IR instrument. The following results were obtained:

| | Oil in water at inlet of separator | Oil in water at outlet of separator |
|---|---|---|
| Widely known impulse type inlet | 110–140 ppm | 400–500 ppm |
| Inlet in accordance with the present invention | 100–150 ppm | 220–300 ppm |

As the results show, the separator inlet in accordance with the present invention produces a much lower content of oil in water (better water quality) at the separator outlet than the well known inlet.

What is claimed is:

1. A separator inlet comprising:

a channel housing;

a spiral channel arranged in said channel housing;

a first line communicating with said spiral channel and arranged so as to be tangential to said spiral channel;

a centrally-located second line communicating with and extending from said spiral channel; and a funnel-shaped gas trap connected to said channel housing.

2. The separator inlet of claim 1, wherein said second line comprises a fluid outlet line, said funnel-shaped gas trap is arranged on an exterior of said channel housing so as to extend below a lower end of said fluid outlet line and so as to communicate with said fluid outlet line.

3. The separator inlet of claim 2, wherein said channel housing is adapted to be positioned in a separator tank at a surface level of a fluid to be separated, said funnel-shaped gas trap being arranged to extend from below said lower end of said fluid outlet line to above the surface level of the fluid to be separated.

4. The separator inlet of claim 1, further comprising mounting parts connected to said channel housing and said funnel-shaped gas trap so as to support said funnel-shaped gas trap.

5. The separator inlet of claim 1, wherein said first line communicates with said second line via said spiral channel.

6. A separator inlet comprising:

a channel housing;

a spiral channel arranged in said channel housing, said spiral channel having a closed bottom surface and an open top;

a first line communicating with said spiral channel and arranged so as to be tangential to said spiral channel; and a centrally-located second line communicating with and extending from said spiral channel.

7. The separator inlet of claim 6, wherein said spiral channel comprises a disc-shaped plate forming said closed bottom surface, and comprises plates extending from said disc-shaped plate so as to form side walls of said spiral channel.

8. The separator inlet of claim 6, wherein said first line communicates with said second line via said spiral channel.

9. A separator inlet comprising:

a channel housing;

a spiral channel arranged in said channel housing, said spiral channel being formed of a disc-shaped bottom plate and side plates sloping in an inward direction toward a central axis of said channel housing;

a first line communicating with said spiral channel and arranged so as to be tangential to said spiral channel; and a centrally-located cylindrical-shaped second line communicating with and extending from said spiral channel, said cylindrical-shaped second line having openings for allowing communication between an interior of said spiral channel and an interior of said second line.

10. The separator inlet of claim 9, wherein said first line communicates with said second line via said spiral channel.

* * * * *